United States Patent [19]

Müssig et al.

[11] Patent Number: 4,603,539

[45] Date of Patent: Aug. 5, 1986

[54] METHOD AND APPARATUS FOR AUTOMATICALLY FRAMING SLIDES IN A FRAMING APPARATUS

[75] Inventors: Herbert Müssig, Murnau; Claus Pohl, Eschenlohe, both of Fed. Rep. of Germany

[73] Assignee: Geimuplast Peter Mundt GmbH & Co. KG., Farchant, Fed. Rep. of Germany

[21] Appl. No.: 537,449

[22] Filed: Sep. 30, 1983

[30] Foreign Application Priority Data

Oct. 5, 1982 [DE] Fed. Rep. of Germany ..... 3236845

[51] Int. Cl.[4] ..... B65B 63/00

[52] U.S. Cl. ..... 53/435; 53/266 R; 53/54; 53/520; 83/371

[58] Field of Search ..... 53/66, 266 R–266 C, 53/435, 520, 521; 83/364, 365, 371, 443; 156/108, 202, 212, 514

[56] References Cited

U.S. PATENT DOCUMENTS

| | | | |
|---|---|---|---|
| 3,469,480 | 9/1969 | Nassenstein et al. | 83/365 X |
| 3,600,997 | 8/1971 | Schmidt | 83/365 X |
| 3,699,832 | 10/1972 | Smith et al. | 83/371 X |
| 3,793,915 | 2/1974 | Hujer | 83/364 X |
| 3,822,624 | 7/1974 | Shoji et al. | 83/371 X |
| 3,892,153 | 7/1975 | Kato | 83/371 X |
| 3,933,069 | 1/1976 | Tall et al. | 83/371 X |
| 3,967,518 | 7/1976 | Edwards | 83/365 X |
| 3,977,280 | 8/1976 | Mundt et al. | 83/443 X |
| 4,098,158 | 7/1978 | Escales et al. | 83/371 X |
| 4,169,399 | 10/1979 | Glöckner et al. | 83/371 X |
| 4,297,930 | 11/1981 | Putzke | 83/443 X |
| 4,436,008 | 3/1981 | Strunc | 83/371 X |

*Primary Examiner*—John Sipos
*Assistant Examiner*—Steven P. Weihrouch
*Attorney, Agent, or Firm*—Fleit, Jacobson, Cohn & Price

[57] ABSTRACT

Methods are proposed for automatically framing slides in a framing apparatus, wherein the slides are subjected at a framing station at the leading end of the slide film passing through the framing apparatus to a framing cycle which comprises individual severing together with introduction in a ready-positioned frame and subsequent transmission of the framed slide to a storage box. One of the disclosed methods is conducted with the aid of marginal notches applied to the slide film by a preceding automatic notcher as a positional criterion for the slides and the other is conducted without regard to such notches. Both methods provide for scanning the spacer strips between slides by means of a scanning apparatus and special evaluation of the information thus obtained, possibly having regard to the notch spacing, in a manner such that a destruction of slides by wrong cuts is avoided. Particular embodiments also permit the automatic excision of excessively wide spacer strips and, in the method that involves a reference to the marginal notches, the sorting out of overlapping slides without an intermediate cut.

10 Claims, 8 Drawing Figures

METHOD AND APPARATUS FOR AUTOMATICALLY FRAMING SLIDES IN A FRAMING APPARATUS

Figure 1:
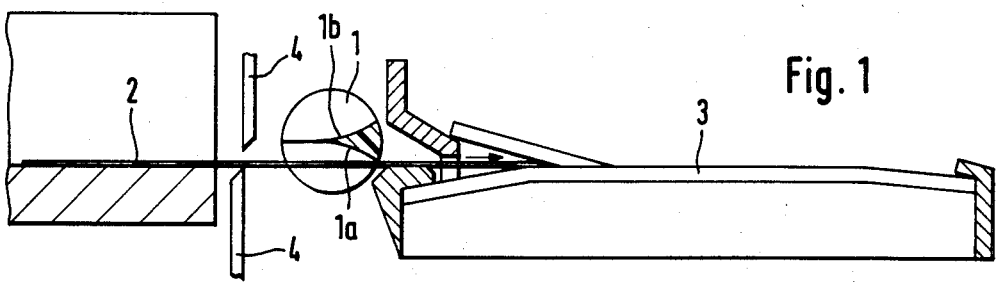

The invention relates to a method for framing slides in a framing apparatus and to an apparatus for automatically cutting film strips.

In known methods, only the individual marginal notches are employed for recognizing the position of a slide on the film. If the automatic notcher has applied the notches correctly, automatic framing of the slides will likewise take place correctly. However, incorrect working of the automatic notcher can occur and in that case the framing method that only has reference to the marginal notches will result in wrong cuts which may destroy the slides.

The invention is based on the problem of improving methods for framing slides in a framing apparatus so that wrong cuts will be eliminated even if the marginal notches are misplaced.

The aforementioned problem is solved by the method herein disclosed.

In the method according to the invention, in contrast with the known methods, the spacing between the marginal notches is measured and the position of the spacer strips between slides is also monitored in relation to the notches, the result of this measurement and monitoring being so evaluated that wrong cuts destroying the slides are avoided.

A method in accordance with the present invention can also include special cycles which can be manually or automatically introduced in the normal framing method if the position of the marginal notches is found to be correct. The method also detects a certain departure of the slide position from that it normally assumes on the film. Variations of the method concern overlapping of two adjacent slides and an excessively wide spacer strip between two slides. According to one of the variations of the method, the overlapping slides are cut out and led to a collecting container instead of to the framing station so as to be available for the customer without damage and, according to a further variation the method, the part of the spacer strip which exceeds the normal width is cut out and led to a waste container.

Another variation of the method relates to a simple procedure when it is found that the position of a marginal notch is wrong in relation to a slide.

Instead of the foregoing variation method, one could, with the greater expense of a plurality of scanning apparatuses or by scanning over a larger zone, automatically continue the framing method when incorrect notching is discovered.

However, it must in every case be expected that a plurality of consecutive notches has been incorrectly applied and it is then advisable to process the remainder of the film in an automatic framing process without regard to the marginal notches. Methods that are particularly suitable for this purpose are described hereinafter. These methods only work with regard to the neutral position and possibly the length of the spacer strips between the slides and can be carried out with the same apparatus because in that case the scanning apparatus is already equipped to detect the spacer strips.

Other variations of the method involve marking of the film that is automatically retained until it reaches the customer and providing sufficient free space for accommodating the individual active structural components of the framing apparatus.

Also disclosed is an apparatus for automatically severing slide films.

The methods of the invention do not require constant supervision because, in the case of danger, there is automatic interruption of the framing method for the slides. It is therefore possible to have one operator for several framing apparatuses, who only needs to see to the replenishment of frames and storage boxes and the manual correction and restarting of the automatic framing method after it has been interrupted.

Figure 2:
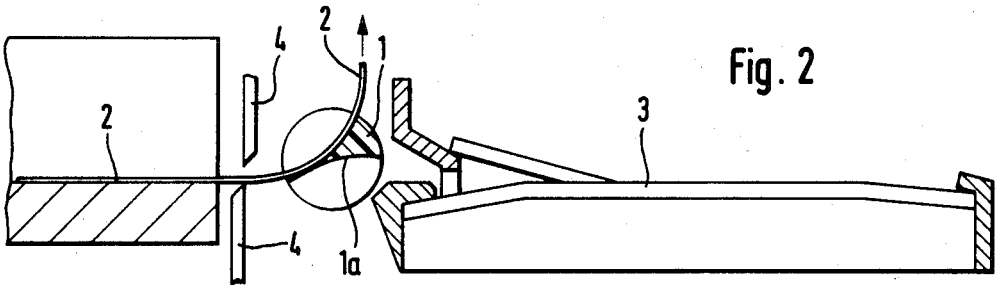
Figure 3:
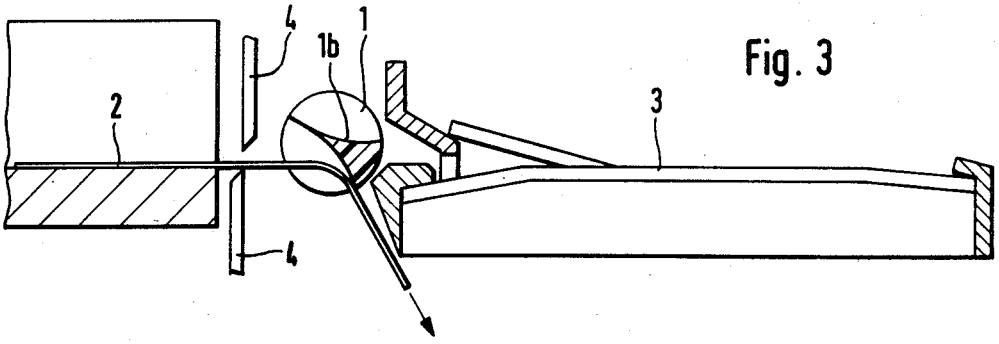

A more detailed description will follow by way of example with reference to the drawing, wherein:

FIGS. 1 to 3 are diagrammatic side elevations of a deflecting apparatus disposed between a slide frame positioned ready for the introduction of a slide and the severing apparatus for severing the film, the FIG. 1 position being that for the introduction of a slide in the frame, FIG. 2 for deflecting overlapping slides to the collecting container and FIG. 3 for diverting disposable film pieces to a waste container, and FIGS. 4 to 8 illustrate slide film sections with different arrangements of the slides on the film, dimensions being shown to which reference will be made hereinafter.

The deflecting apparatus shown in FIGS. 1 to 3 is controlled by a control device which comprises a microprocessor and operates depending on the findings of a film scanning apparatus (not shown) disposed several slide widths in the upstream direction and scanning the film as to the position and spacing of the marginal notches, position, width and spacing of the spacer strips, etc. The scanning apparatus itself is preferably an electro-optical device.

The deflecting apparatus 1 of FIGS. 1 to 3 comprises deflecting surfaces 1*a* and 1*b* which, depending on their position beyond the path of travel of the film 2, are disposed in a ready-positioned slide frame 3 or block this path and guide the leading end of the film behind the severing apparatus 4 either upwardly to a collecting container (1*b* in FIG. 2) or downwardly into a waste container (1*a* in FIG. 3).

Figure 4:
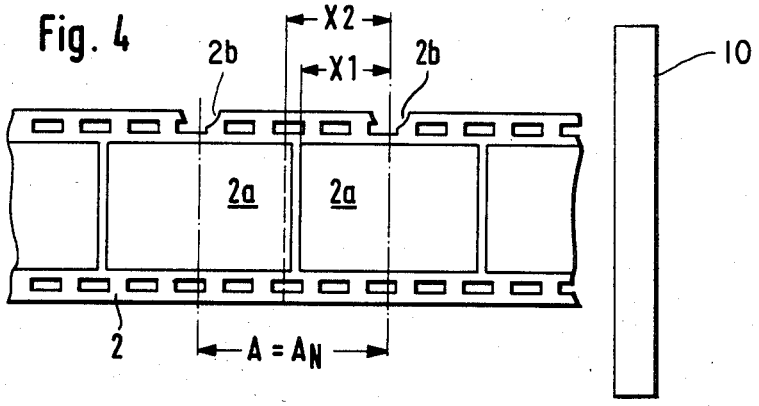
Figure 7:
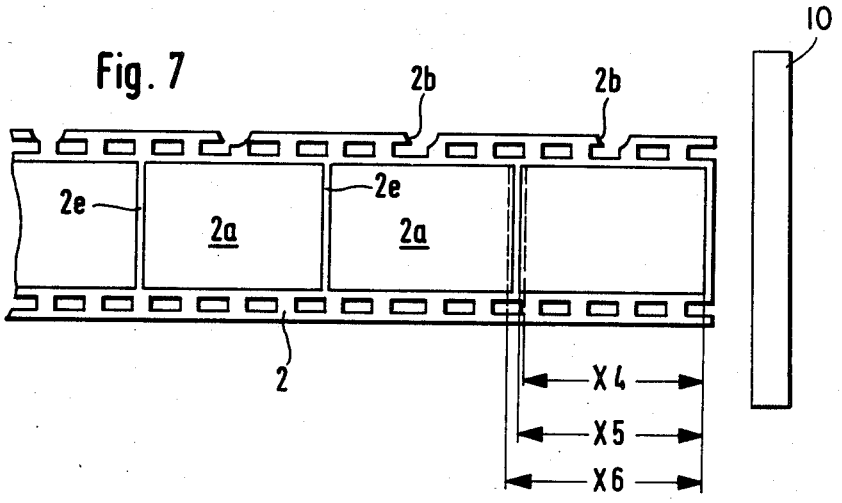

FIGS. 4 and 7 show sections of slide films 2 on which the individual slides 2*a* have their correct normal position and to which the automatic notcher has applied in correct relationship a notch 2*b* at the margin of the film and at the respective middle of the slide. FIG. 4 shows spacing measurements to which reference will hereinafter be made in conjunction with carrying out of the method with regard to the notches. FIG. 7 contains spacing measurements which are significant when carrying out the method without regard to the marginal notches 2*b*.

Figure 5:
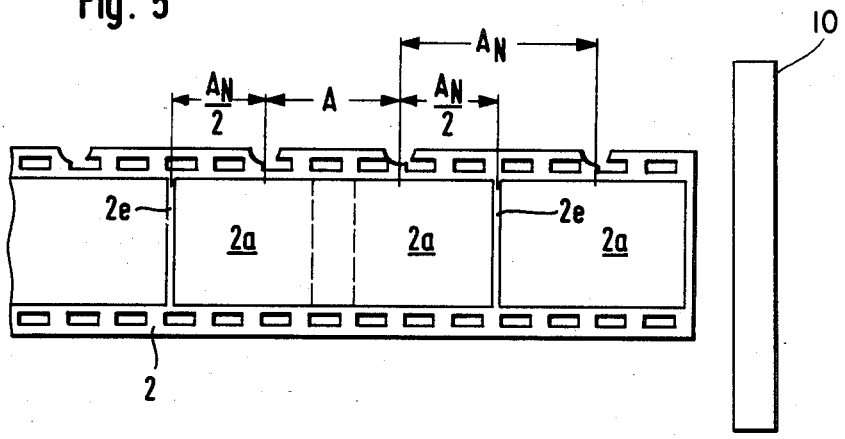

FIG. 5 shows the section of a film 2 in which two slides 2*a* overlap without any spacer strip therebetween. The spacing measurements shown in FIG. 5 will be referred to in relation to carrying out the framing method with regard to the marginal notches.

Figure 6:
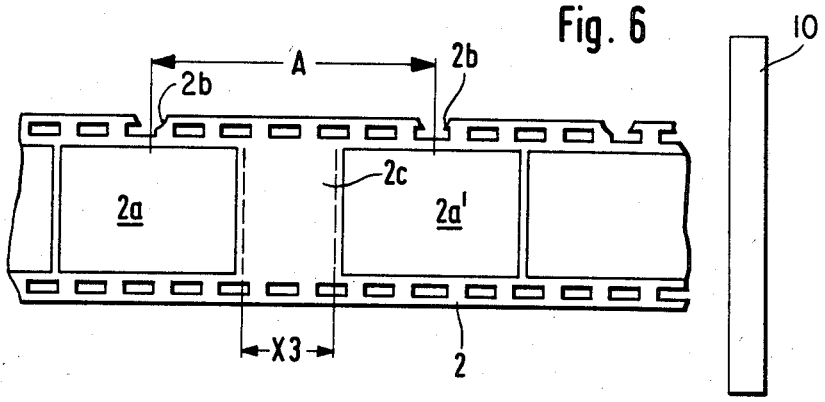
Figure 8:
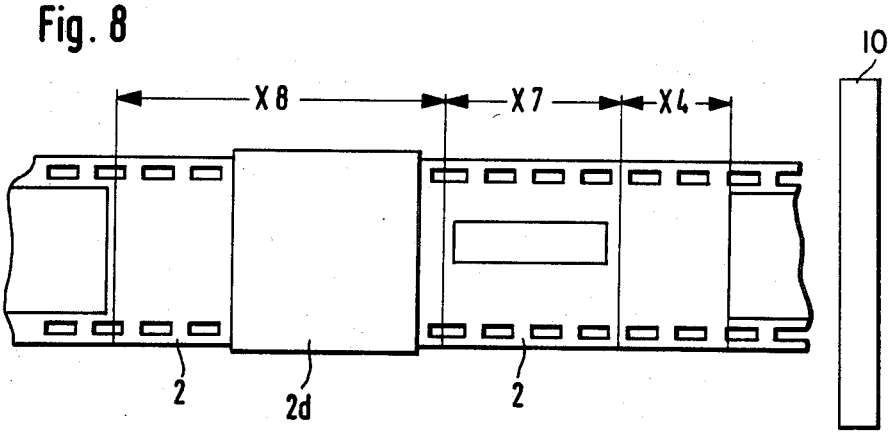

FIG. 6 shows the section of a film 2 in which an excessively wide spacer strip 2*c* occurs between two adjacent slides 2*a* and 2*a'*. Such a film section can be processed with the aid of a simple single scanning apparatus both by the method having regard to the marginal notches as well as the method that has no regard thereto. FIG. 8 shows the end sections of two adjoining slide films 2 interconnected with the aid of an adhesive strip 2*d*. In the feeding direction of the films 2, the one in front of the adhesive location 2*d* has adhered to it a label which contains the film number and has a length equal to the normal slide width, the label being detectable in the same way as a slide by a special scanning device of the scanning apparatus, for example an infrared scanner. The film section according to FIG. 8 can be automatically processed by a single scanning apparatus of simple construction according to the method that has regard to the maginal notches as well as the method that has no regard to these notches.

The method of automatically framing the individual slides with regard to the marginal notches is conducted as follows.

First, a reel consisting of several slide films adhered with their leading ends to the trailing ends is inserted in an unwinding apparatus. Thereafter, the leading section of the film is inserted in the film path of the automatic framing apparatus and the deflecting apparatus 1 is set to the 'down' position of FIG. 3 by a key. This is only necessary at the start of a reel of film. In the set position, the deflecting apparatus blocks the path to the opened frame 3 and guides the leading section to a waste container (not shown) below the framing station. This occurs when the frame feed is uncoupled with the aid of a magnet so that during the subsequent operating cycle the leading section is cut off up to directly in front of the first slide but no new slide frame is advanced because an empty frame 3 is still located at the framing station from the preceding normal framing cycle. The supply of the slide frames to their framing position is preferably in a direction opposite to the film feed but could also be from the side, it being preferable to use a one-piece slide frame which is splayed apart at the end facing the slide in the manner shown in FIGS. 1 to 3 for the purpose of introducing the slide. Severing of the leading end can be carried out under manual control, this step as well as the other operations hereinafter described being stored until the detected correct line of cut arrives at the severing apparatus 4 if the scanning apparatus is some distance in front of the severing apparatus as in the present example. The sequence of operation will now be described as it occurs at the scanning station and then as it is conducted at the framing station of FIGS. 1 to 3 after the time delay caused by feeding the film from the scanning apparatus to the framing station.

After starting the automatic programme, the film deflector returns to the framing position of FIG. 1.

It will be assumed that the first slide 2*a* is followed by further slides having the arrangement according to FIG. 4. The scanning apparatus 10 will then detect a spacing $A_N$ to the next marginal notch 2*b* that corresponds to the normal value (with a certain permissible tolerance) and, in conjunction therewith, the presence of a spacer strip or a leading spacer strip edge in the tolerance range determined by the difference of the values $X2-X1$, such a tolerance range corresponding to a slide width of 36 to 42 mm in the case of miniature films. The first slide, which is correctly set before starting the automatic programme and could be recognized by the operator as a normal slide, is in any case subjected to a normal framing cycle at the framing station, consisting of first partially introducing the slide in the frame, then severing it from the leading end of the film by means of the severing apparatus 4, then pulling it completely into the frame and ejecting the frame into a box while replacing it with a new frame. Following detection of the aforementioned spacing conditions with regard to the spacing between the marginal notch of the first slide and the notch of the following slide and the spacing of the trailing spacer strip edge of the following slide from the associated marginal notch, a normal framing cycle is also automatically introduced for the following slide and this process is repeated for each slide as long as the aforementioned spacing conditions are found to exist.

It will now be assumed that a film section according to FIG. 5 arrives at the scanning station. In this case, the scanning apparatus 10 detects a correct spacing between the first of the two marginal notches associated with the overlapping slides and the preceding notch. However, it fails to detect within the tolerance range for this first marginal notch any trailing spacer strip edge for the reason that no spacer strip exists at this position. This combination of data could, for example, be employed to bring the framing apparatus to a standstill. According to the method of the invention, however, processing is continued automatically, namely in that a first special cycle is carried out which, with uninterrupted frame feeding, comprises displacing the slide film relatively to the severing apparatus through a distance corresponding to the spacing $A_N$ while deflecting the front end of the film into the collecting container and subsequently severing the leading end of the film as governed by the second of the notches located in the overlapping zone. This special cycle is only carried out if for the second notch of the overlapping zone the front edge of a trailing spacer strip has been detected in the tolerance range, which means that a cut may take place. The scanning apparatus was able to detect the aforementioned overlapping condition in that no spacer strip was found in the overlapping zone for the first notch and the spacing A to the next notch 2*b* is smaller than the normal spacing $A_N$.

If monitoring of the slide following the overlapping zone again detects the existence of normal spacing conditions, the method is continued with a normal framing cycle. For this purpose, a frame to introduce the slide is still positioned in readiness from the previously conducted normal framing cycle.

If, now, a film strip 2 according to FIG. 6 reaches the scanning apparatus 10, then the latter will recognize a spacer strip between the last slide 2*a'* to be framed normally and the following slide 2*a* but will not detect any trailing spacer strip edge in the tolerance range in relation to the marginal notch 2*b* of the last-mentioned slide. This is the criterion for the presence of an excessively wide spacer strip 2*c* with an excessive width X3 between the aforementioned slides but a second special cycle is preferably automatically carried out. With the frame feeding stopped, this second special cycle comprises advancing the slide film 2 in relation to the severing apparatus 4 through a distance corresponding to the extent X3 by which the marginal notch spacing exceeds the normal value and subsequent severing of the advanced film section at the leading end of the film during deflection into the waste container. In this way, the excessively wide spacer strip section is cut out.

For the first special cycle, the deflecting apparatus 1 is brought to the FIG. 2 position and for the second special cycle to the FIG. 3 position.

If a correctly disposed slide now follows, then the scanning apparatus will again detect the normal condition and a normal framing cycle will take place.

The criterion for the presence of a wrong notch in relation to the slides is a normal notch spacing with the simultaneous absence of a spacer strip in the tolerance range for the trailing of the two marginal notches of which the spacing was found to be correct. If the scanning apparatus detects this condition (not shown in the drawing), the apparatus is stopped to enable a check to be made by the operator. Frequently, he will then also detect wrong notchings for the subsequent slides and the following method will be proceeded with without reference to the marginal notch 2*b*.

In the method that has no regard to the marginal notch 2*b*, the scanning apparatus 10 monitors the slide film only for the presence of the leading edge of a spacer strip in a predetermined tolerance range X6−X4 (FIG. 7) of the spacing from the trailing edge of the preceding spacer strip. The normal framing process conducted as an uninterrupted cycle slide by slide with only one step between successive slides will be continued for a following slide only if such monitoring proved to be positive, that is to say the trailing edge was detected at a spacing X5. This method can also be conducted on films which have no marginal notch whatsoever. It can be carried out very simply in that, after detecting the leading edge of the first slide to be framed that was for example correctly set in relation to the scanning apparatus by the operator after the interruption, the slide film is first advanced through the distance X4 without regard to the contents of the image (which could contain representations that look like a spacer strip) and only thereafter will the detection programme for the trailing edge of the image for this slide be introduced in the spacing zone X6−X4. If this detection programme is positive, the normal framing step is continued.

If, during the conduct of this method, a film strip according to FIG. 6 with an excessively wide spacer strip 2*c* reaches the scanning station, then the scanning apparatus detects the presence of the leading edge of the trailing spacer strip for the slide being scanned but will detect the trailing edge for the trailing spacer strip only at a spacing from the leading one that exceeds the normal value. This is the criterion for the necessity to cut out the section having the excessive width X3 and a third special cycle is then carried out which, with the frame feed shut off, comprises displacing the slide film 2 relatively to the severing apparatus 4 through a distance corresponding to the distance X3 and subsequently severing the advanced film section at the leading end of the film during deflection into the waste container. This special cycle can be automatically introduced in the normal framing process by means of a simple scanning apparatus.

In the method as just described, overlapping images are detected by a simple scanning apparatus in that for the trailing edge of a spacer strip it fails to find the leading edge of the following spacer strip within the tolerance range. However, a simple scanning apparatus will thereby also lose its orientation relatively to the film and can no longer detect where the next cut is to be made. In that case, the framing apparatus is brought to a standstill so that an operator can undertake new orientation at the trailing edge of the spacer strip preceding the next following ordinary slide.

In this case, automatic continuation of the method could be achieved in the same way as for carrying out the method that takes regard of the notch spacing if provision is made for a plurality of scanning apparatuses simultaneously monitoring a plurality of slides or for monitoring over a larger zone which necessitates more complicated scanning equipment.

The automatic processing of a film section according to FIG. 8 is possible by the method that takes regard of the marginal notches 2*b* as well as by the method which only takes regard of the spacer strips. The section X7 with the adhered marking label is treated in the same way as a correctly positioned slide insofar that the scanning apparatus is equipped with appropriate detection means and the sections X4 and X8 are automatically processed as excessively wide spacer strips and discharged into the waste container. Following framing of the marking label and its introduction in the receiving box, which is preferably transparent so that the marking label can be read from the outside, the receiving box is also replaced by an empty one so that the slides from the next film can now reach a box of their own.

The invention extends to an apparatus for automatically severing slide films.

Summarising, in known methods and apparatus for cutting a slide film between frames (pictures), irrespective of whether the severed film sections are immediately mounted in frames to form the slides or mounting is performed subsequently, regard is had solely to marginal notches applied to the film at intervals in a separate operation. If these notches are for some reason misaligned in relation to the pictures, cutting will take place incorrectly and as much as the entire film could be spoilt. Even if the notches are properly associated with the pictures, the latter could be incorrectly spaced from one another or overlap one another on the film, in which case it used to be necessary to perform or continue operation of known machines by hand.

By means of the invention, however, account is taken of the spacer strips (blank film between adjacent pictures), that is to say whether a spacer strip is missing because the pictures overlap or whether a spacer strip is too wide because of incorrect film feeding or non-exposure.

We claim:

1. A method for automatically framing slides in a framing apparatus in which the slides are subjected at a framing station at the leading end of the slide film passing through the filming apparatus to a framing cycle which comprises individual severing of slides together with introduction in a ready-positioned frame and subsequent transmission of the framed slide to a storage box, wherein the position of the individual slides on the film is detected by an automatic film scanning apparatus of a control device which controls the relationship of the film feed to the severing apparatus of the framing station in the sense of arranging the lines of cut in a correct relationship to the images of the individual slides, said method comprising:

providing a slide film having a plurality of individual slides with consecutive individual slides intended to be in spaced relationship at a predetermined spacing defined by spacer strips therebetween having an intended predetermined width along the slide film, and with at least one marginal notch for each slide and intended to have a predetermined reference position with respect to an associated slide to enable it to be used as a frame marking detectable by a film scanning means, measuring the passing slide film for the spacing between successive marginal notches, comparing the measured spacing between notches with a reference notch spacing value corresponding to a normal notch spacing between successive notches, sensing whether a spacer strip is present for each notch in a predetermined spacing tolerance range measured from the predetermined reference position, and cutting the film between successive slides only if the measured marginal notch spacing corresponds with the given notch spacing reference value resulting from correct operation of the notching apparatus and correct feeding of the slide film in the camera, and if a spacer strip has been sensed and has a width that corresponds with the predetermined spacing tolerance range between consecutive slides.

2. A method according to claim 1 in conjunction with slide films which normally have a single marginal notch for each side, wherein the measurement of the notch spacing is taken from a first notch to a next succeeding notch and the sensing of the presence of a spacer strip senses a spacer strip that is downstream of said first notch relative to the direction of movement of the slide film.

3. A method according to claim 2, in conjunction with slide films prenotched by a notching apparatus which provides two marginal notches for two slides that overlap without a spacer strip but otherwise lie between spacer strips, one of the notches being disposed downstream of a first spacer strip and the other notch being upstream of a second spacer strip downstream of said first spacer strip and at the same spacing as the reference value, said method including: performing a first special cycle which includes interrupting the frame feed, advancing the slide film relative to the severing apparatus by a distance corresponding to the spacing between two successive marginal notches while diverting the leading end of the film to a separate collecting container, and subsequent severing of the leading end of the film based upon the position of the trailing notch of the two consecutive notches if the measurement of the notch spacing between the two consecutive notches has resulted in a value less than the normal notch spacing value and if the sensing for the presence of a spacer strip in the predetermined spacing tolerance range measured from said trailing notch has been positive.

4. A method according to claim 2, said method including: performing a second special cycle if the measurement of the notch spacing is a value between the reference notch spacing value and twice the reference notch spacing value, and sensing for the presence of a spacer strip in the predetermined spacing tolerance range measured from the first notch has been positive, the second special cycle, with the frame feed switched off, comprising advancing the slide film relative to the severing apparatus by a distance corresponding to the extent by which the notch spacing exceeds the reference notch spacing value and subsequent severing of the length of film advanced while diverting it to a separate waste container.

5. A method according to claim 1, including stopping the movement of the slide film when the measurement of the notch spacing corresponds with the reference notch spacing value and no spacer strip in the predetermined spacing tolerance range measured from an upstream notch has been sensed.

6. Apparatus for automatically severing film strips with the aid of marginal notches in which a notch is associated with each of a plurality of spaced images on the strip at a predetermined reference position with respect to the image, the notches having been applied to permit scanning of the spacer strips between adjacent images, said apparatus comprising: means for monitoring the passing film strip for the existence of a permissible minimum spacing between successive marginal notches and for sensing the passing film strip for the presence of spacer strips between consecutive images at a permissible spacing from the marginal notches, means for severing images from the film strip, and control means responsive to said monitoring means to control said severing means to be operative if the permissible minimum notch spacing and the permissible spacer strip spacing from a notch are sensed by said monitoring means, a normal severing step being a single cut between two consecutive notches.

7. Apparatus according to claim 6, wherein said monitoring means is operative for determining whether the permissible spacing between a notch and a spacer strip following it exists and for determining whether an impermissibly small spacing exists between consecutive notches, so that if the permissible spacing between a notch and a spacer strip following same and the permissible spacing between consecutive notches are not sensed by said monitoring means, no cut is made.

8. Apparatus according to claim 6, wherein said monitoring means is operative for determining whether the permissible spacing between a notch and a spacer strip preceding and following it exists and for determining whether an impermissibly large spacing exists between consecutive notches, so that if the permissible spacing between a notch and a spacer strip preceding and following it and the permissible spacing between consecutive notches are not sensed by said monitoring means, the excessively wide strip between the image sections corresponding to the excessively large notch spacing is cut out from the strip.

9. Apparatus according to claim 6, including means for stopping the apparatus responsive to an impermissible spacing between the following notch and the spacer frame preceding or following it.

10. Apparatus according to claim 6, wherein the severing apparatus is followed by a framing machine.

* * * * *